US006458224B1

(12) United States Patent
Ren et al.

(10) Patent No.: US 6,458,224 B1
(45) **Date of Patent: *Oct. 1, 2002**

(54) ALUMINUM ALLOYS WITH OPTIMUM COMBINATIONS OF FORMABILITY, CORROSION RESISTANCE, AND HOT WORKABILITY, AND METHODS OF USE

(75) Inventors: Baolute Ren, Glen Allen, VA (US); Subhasish Sircar, Richmond, VA (US); William A. Cassada, III, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/564,053

(22) Filed: May 3, 2000

Related U.S. Application Data

(60) Provisional application No. 60/171,598, filed on Dec. 23, 1999.

(51) Int. Cl.[7] ..... C22C 21/00

(52) U.S. Cl. ..... 148/437; 420/540; 420/548; 420/551; 420/553

(58) Field of Search ..... 148/437; 420/540, 420/551, 553, 548

(56) References Cited

U.S. PATENT DOCUMENTS

| | | | |
|---|---|---|---|
| 3,878,871 A | 4/1975 | Anthony et al. | 138/140 |
| 4,649,087 A | 3/1987 | Scott et al. | 428/654 |
| 4,749,627 A | 6/1988 | Ishikawa et al. | 428/654 |

(List continued on next page.)

FOREIGN PATENT DOCUMENTS

| | | |
|---|---|---|
| EP | 0893512 | 1/1999 |
| EP | 0899350 | 3/1999 |
| JP | 57203743 | 12/1982 |
| JP | 5125472 | 5/1993 |
| JP | 5148572 | 6/1993 |
| JP | 5263172 | 10/1993 |
| JP | 5271833 | 10/1993 |
| JP | 5320798 | 12/1993 |
| JP | 6212371 | 8/1994 |
| WO | WO 91/14794 | 10/1991 |
| WO | WO 93/20253 | 10/1993 |
| WO | WO 99/04050 | 1/1999 |
| WO | WO 99/04051 | 1/1999 |

OTHER PUBLICATIONS

"Standard Proctice for Modified Salt Spray (Fog) Testing", American Society for Testing and Materials, Designation: G 85–94, pp. 350–355, Apr. 1994.

J.R. Galvele et al., "Mechanism of Intergranular corrosion of A1–Cu Alloys", pp. 795–807, presented at the 4th International Congress on Metallic Corrosion, Amsterdam, Sep. 7–14, 1969.

(List continued on next page.)

*Primary Examiner*—Roy King
*Assistant Examiner*—Janelle Combs-Morillo
(74) *Attorney, Agent, or Firm*—Christopher W. Brody; David Pearce-Smith

(57) ABSTRACT

An aluminum alloy article containing the alloying amounts of iron, silicon, manganese, titanium, and zinc has controlled levels of iron and manganese to produce an alloy article that combines excellent corrosion resistant with good formability. The alloy article composition employs a controlled ratio of manganese to iron and controlled total amounts of iron and manganese to form intermetallic compounds in the final alloy article. The electrolytic potential of the intermetallic compounds match the aluminum matrix of the article to minimize corrosion. The levels of iron and manganese are controlled so that the intermetallic compounds are present in a volume fraction that allows the alloy article to be easily formed. The aluminum alloy composition is especially adapted for extrusion processes, and tubing that are used in heat exchanger applications.

10 Claims, 5 Drawing Sheets

U.S. PATENT DOCUMENTS

| | | | | |
|---|---|---|---|---|
| 4,828,794 A | | 5/1989 | Scott et al. | 420/529 |
| 5,125,452 A | | 6/1992 | Yamauchi et al. | 165/133 |
| 5,286,316 A | | 2/1994 | Wade | 148/550 |
| 5,503,690 A | | 4/1996 | Wade et al. | 148/550 |
| 5,906,689 A | * | 5/1999 | Sircar | 148/439 |
| 5,976,278 A | | 11/1999 | Sircar | 148/550 |

OTHER PUBLICATIONS

Ahmed, "Designing of an Optimum Aluminum Alloy for De–salination Applications", pp. 255–261, Strength of Metals and Alloys, vol. 1, Proceeding of the 6th International Conference, Melbourne, Australia, Aug. 16–20, 1982.

I.L. Muller et al., Pitting Potential of High Purity Binary Aluminum Alloys—1; pp. 180–183, 186–193, 1977.

* cited by examiner

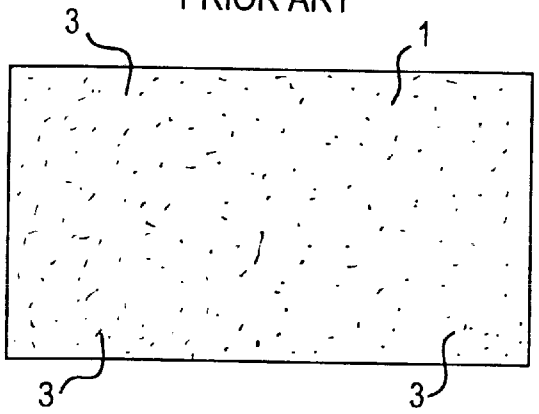
FIG. 1
PRIOR ART
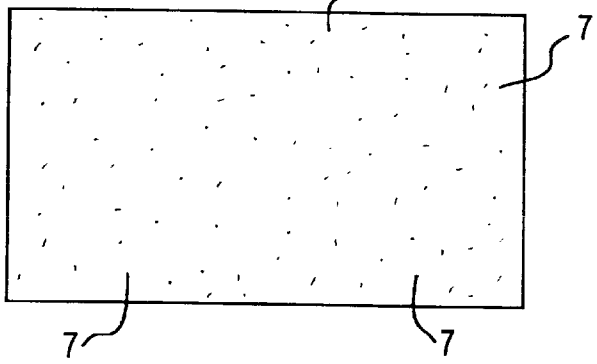
FIG. 2
PRIOR ART
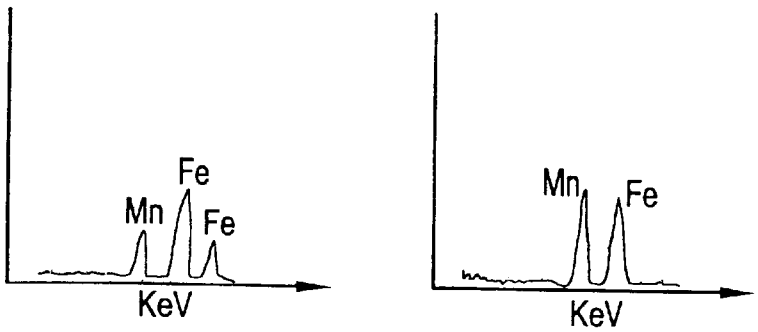
FIG. 3
PRIOR ART
FIG. 4
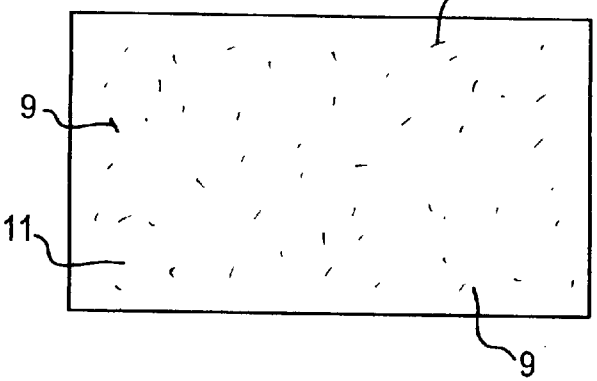
FIG. 6

FIG. 5

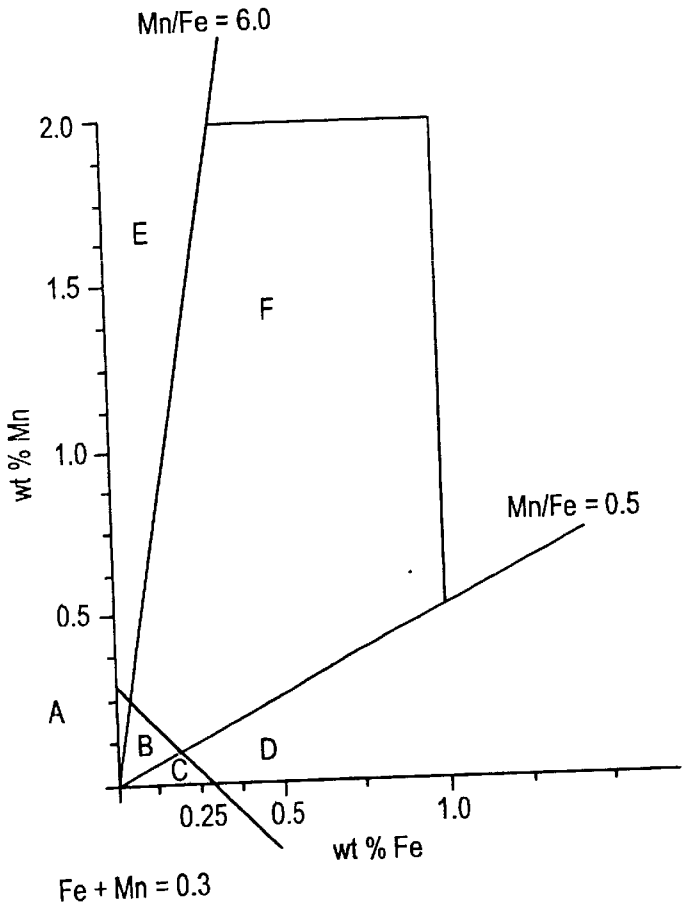

KEY

A good corrosion resistance but poor formability based on inadequate volume fraction of intermetallics B good corrosion resistance but poor formability based on inadequate volume fraction of intermetallics C poor corrosion resistance and poor formability based on inadequate volume fraction of intermetallics and intermetallic particle composition D poor corrosion resistance based on intermetallic composition but good formability based on adequate volume fraction of intermetallics E good corrosion resistance but poor formability based on excessive Mn/Fe ratio F ideal corrosion resistance, formability and extrudability

ALUMINUM ALLOYS WITH OPTIMUM COMBINATIONS OF FORMABILITY, CORROSION RESISTANCE, AND HOT WORKABILITY, AND METHODS OF USE

This application claims priority under 35 U.S.C. §119(e) from provisional patent application serial No. 60/171,598, filed on Dec. 23, 1999.

FIELD OF THE INVENTION

The present invention is directed to aluminum alloys with optimum combinations of formability, brazeability, corrosion resistance, and hot workability, and methods of use, and in particular, to aluminum alloys having controlled levels of manganese and iron, and a controlled chemistry and levels of intermetallic particles to provide optimum performance in applications such as heat exchangers.

BACKGROUND ART

In the prior art, aluminum alloys are the alloys of choice for heat exchanger applications. These alloys are selected for their desirable combination of strength, low weight, good thermal and electrical conductivity, brazeability, optimum corrosion resistance and formability.

Typical applications for heat exchangers include automotive heater cores, radiators, evaporators, condensers, charge air coolers and transmission/engine oil coolers. One particular application that requires a good combination of properties is tubing for radiators, condensers and the like. In these applications, fin stock is arranged between stacked tubing and end sheets that carry the heat transfer media. The tubing is situated between headers which redirect the heat transfer media flow between layers of tubing and which also can contain the heat exchanger inlets and outlets.

In one particular application, the tubing is formed into a u-shape and is threaded through openings in the fin stock and also through openings in end sheets adjacent to the fin stock ends. Once the tubing is inserted, the tubing is internally and diametrically expanded to maximize the metal-to-metal contact with the fin stock and the end sheet, and heat exchange between the tubing and the fin stock.

After the insertion and expansion, the free ends of the tubing extend beyond the fin stock and end sheet for attachment to the header manifold. The length of extension of the tubing beyond the fin stock and end sheet once expanded is critical for subsequent header manifold attachment. This height extending past the end sheet after the expansion process is commonly referred to as a "stickup height." If the length is insufficient for header manifold attachment on just one of the many tubes interleaved in the fin stock, the entire heat exchanger must be rejected. As part of the expansion, the tubing end also becomes bell-shaped with a bell diameter. The measurement of stickup height and the bell diameter gives a good measure of the forming performance and can be used as a standard to determine whether the assembly can be further processed into a complete heat exchanger.

During the expansion step, the tubing will change its dimension, shrinking from its original installed length. This shrinkage can result in a reduction in the stickup height of the free ends of the tubing extending beyond the fin stock and end sheet for header attachment, and rejection of the heat exchanger. Thus, besides the other mechanical properties associated with the aluminum alloys typically used in heat exchanger application, this "stickup height" is crucial and the alloys must exhibit the necessary formability to allow for the expansion without excessive shrinkage and the like.

A current alloy used in these types of applications is AA3102. The Aluminum Association specifies, in weight percent, a compositional makeup for this alloy of up to 0.40% silicon, up to 0.7% iron, up to 0.1% copper, between 0.05 and 0.40% manganese, up to 0.05% zinc, up to 0.03% titanium, with the balance aluminum and inevitable impurities, each impurity up to 0.03%, and total impurities up to 0.10%. This alloy has excellent formability but poor corrosion resistance. Consequently, while the alloy performs ideally in heat exchanger manufacture, the alloy must be coated for corrosion protection.

It is believed that the intermetallic particles found in the matrix of AA3102 contribute to its good formability. FIG. 1 shows a schematic of a micrograph of an AA3102 alloy. The schematic shows a matrix of aluminum designated by the reference numeral 1 and a volume fraction of intermetallic particles 3 distributed throughout in the alloy matrix. This distribution is generally about 3.0% by volume of intermetallics in these prior art alloys. At the same time, the particles 3 are primarily $FeAl_3$, which have an electrolytic potential differing greatly from the aluminum matrix. As explained in more detail below, with the $FeAl_3$ being less negative than the matrix of pure aluminum, the matrix corrodes first under SWAAT conditions. SWAAT corrosion testing uses a well known testing standard, i.e., ASTM G85 Annex 3, and does not need further description for understanding of the invention. Consequently, AA3102 has poor corrosion resistance and must be coated when used in heat exchanger applications.

Other alloys have been developed as disclosed in U.S. Pat. Nos. 5,906,689 and 5,976,278 to Sircar (hereby incorporated in their entirety by reference), which offer high hot workability and improved corrosion resistance. The corrosion resistance of these alloys is so superior to prior art alloys that the need for coating the alloys is eliminated. One reason for this is that the number of intermetallic particles, e.g., $FeAl_3$, that adversely affect corrosion resistance is less.

However, these new alloys lack the intermetallic particle distribution/density that exists in AA3102. As can be seen from FIG. 2, these highly corrosion resistant alloys have a matrix 5 and dispersed intermetallics 7. The schematic of FIG. 2 depicts only about 0.1% volume fraction distribution of the intermetallics 7. As a result of the lower volume fraction of intermetallics 7, these alloys may sometimes lack the needed formability for certain heat exchanger manufacturing operations.

Consequently, a need exists to provide an aluminum alloy composition that combines formability, hot workability and corrosion resistance in one alloy, and an alloy adapted especially for particular use in heat exchanger manufacturing and applications.

SUMMARY OF THE INVENTION

Accordingly, it is a first object of the present invention to provide an aluminum alloy having an optimum combination of hot workability, brazeability, corrosion resistance, and formability.

Another object of the present invention is a method of manufacturing the inventive aluminum alloy for use in heat exchanger applications or a method of making the alloy as a sheet or strip rather than tubing for use in other applications wherever the combination of excellent corrosion resistance, brazeability, and formability is desired. Sheet product may also be used to make tubes as found in typical radiators and heater cores.

A still further object of the present invention is a method of manufacturing articles requiring forming the alloys, particularly, expanding the alloys. In particular, the inventive method is directed to improvements in making heat exchangers where the tubing is expanded as part of the assembly process.

Yet another aspect of the invention is the ability to improve formability and provide excellent corrosion resistance in an aluminum alloy without significantly affecting hot workability as compared to conventional alloys and those described in U.S. Pat. Nos. 5,906,689 and 5,976,278 to Sircar.

Other objects and advantages of the present invention will become apparent as a description thereof proceeds.

In satisfaction of the foregoing objects and advantages, the present invention provides an aluminum alloy article made of an alloy composition comprising, in weight percent:

between about 0.05 and 0.5% silicon;

an amount of iron between about 0.1% and up to 1.0%;

an amount of manganese up to about 2.0%;

between about 0.06 and 1.0% zinc;

between about 0.03 and 0.35% titanium;

with the balance aluminum and inevitable impurities;

wherein the manganese to iron ratio is maintained between greater than about 0.5 and less than or equal to about 6.0, and the iron and manganese amounts total greater than about 0.30%, such that the article contains intermetallic compounds dispersed throughout an aluminum matrix in a volume fraction of the article of at least 0.5%, preferably at least about 2.0%, and wherein a difference in electrolytic potential between an aluminum matrix of the article and the intermetallic compounds is less than about 0.2 volts. The intermetallic compounds can have an aspect ratio of less than about 5.0. The intermetallic compounds can range in size from about 0.5 to 5 microns.

In a preferred embodiment, the ratio of manganese to iron is further limited to a lower limit of 0.75 and an upper limit of about 5.0, more preferably between 1.0 and 4.0, and the manganese and iron total amount is at least about 0.6%, and more preferably between about 0.7 and 1.2%.

The inventive alloy is preferably utilized in extrusion processes that make tubing, particularly, extrusion processes designed to make heat exchanger tubing. The alloy can also be used in sheet form where formability is important.

In another aspect of the invention, the inventive alloy is ideally suited for methods of making heat exchangers that employ an expansion step of the tubing. The alloy composition of the invention, when expanded as part of these processes is superior in terms of formability and providing the requisite stick-up height needed for the manufacturing process. A preferred tubing size is 6 mm in diameter but other sizes can be employed.

The invention also entails a method of improving the corrosion resistance and formability of an aluminum alloy article without loss of hot workability by providing an aluminum alloy composition comprising alloying amounts, in weight percent, of between about 0.05 and 0.5% silicon, an amount of manganese up to about 2.0%, an amount of iron between about 0.1% and up to about 1.0%, between about 0.03 and 0.35% titanium, and between about 0.06 and 1.0% zinc, with the balance aluminum and inevitable impurities, and forming the article, wherein the ratio of manganese to iron in the composition is controlled to between about 0.5 and 6.0, and the total amount of iron and manganese in the composition is controlled to be greater than about 0.3%, so as to form a finished microstructure in the article having greater than about 0.5% volume fraction of intermetallic compounds, the intermetallic compounds having an aspect ratio less than 5.0, and wherein an electrolytic potential difference between an aluminum matrix of the article and the intermetallic compounds is less than about 0.2 volts.

BRIEF DESCRIPTION OF THE DRAWINGS

Reference is now made to the drawings of the invention wherein:

FIG. 1 is a schematic of a micrograph of an AA3102 alloy showing the intermetallic particles and their distribution;

FIG. 2 is a schematic of a micrograph of an alloy according to U.S. Pat. No. 5,906,689, showing intermetallic particles and their distribution;

FIG. 3 is a schematic of an energy dispersive spectroscopy chart indicating the compositional makeup of the intermetallics of AA3102 and the intermetallics of the alloy described in U.S. Pat. Nos. 5,906,689;

FIG. 4 is a schematic of an energy dispersive spectroscopy chart indicating the compositional makeup of intermetallics of an alloy according to the invention;

FIG. 5 is a graph and key outlining the limits for iron and manganese for the invention;

FIG. 6 is a schematic of a micrograph showing intermetallics of an alloy containing excessive manganese when compared to iron;

DESCRIPTION OF THE PREFERRED EMBODIMENTS

Figure 7:
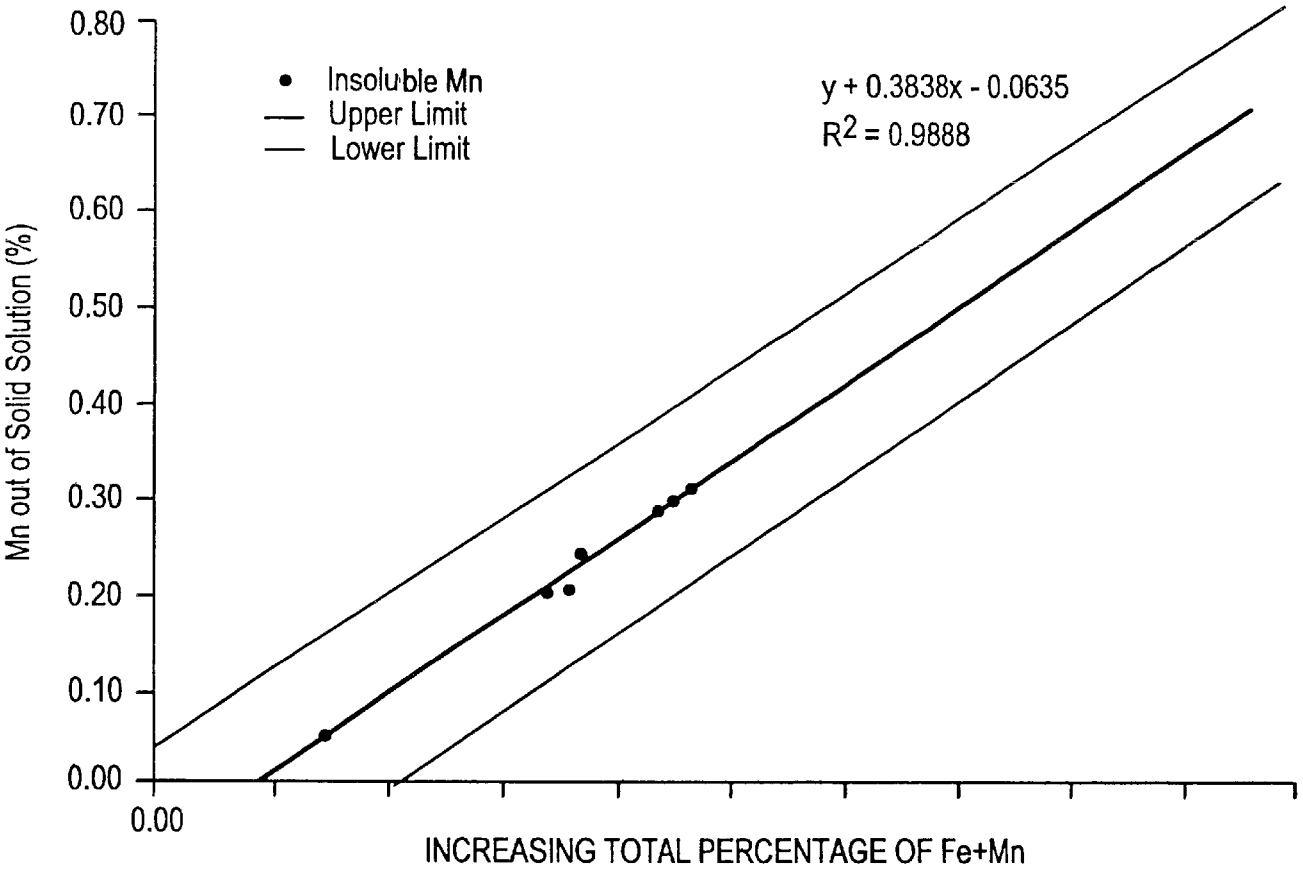
FIG. 7 is a graph comparing the total amount of iron and manganese to the manganese out of solution for a number of aluminum alloys.

The invention offers significant advancements in the field of aluminum alloys for particular use in heat exchanger applications where corrosion resistance, formability, brazeability, and hot workability are needed. Hot workability is intended to encompass all hot working techniques, including rolling, extruding and the like. Particular use relates to making tubing using the inventive alloy, the tubing mated with fin stock and expanded as part of a heat exchanger manufacturing process.

The inventive aluminum alloy is tailored through adjustment of the levels of manganese and iron while maintaining the necessary volume fraction and chemistry of intermetallic particles to achieve an unexpected combination of formability, extrudability, and corrosion resistance. Tubing for heat exchangers, particularly condensers, can be threaded into fin stock stacks, extruded and/or bent into a u-shape without difficulty, that is, they have minimal or no surface defects such as orange peel, wrinkling and the like. The tubing can be inserted into fin stock and expanded without adversely affecting the available stickup height. In addition, the corrosion resistance is at least equivalent to known alloys for heat exchanger use that do not require coatings, and is believed to be even superior to such alloys. It should be understood that measures of corrosion resistance between the prior art alloys and the inventive alloys are made with reference to the SWAAT testing standards and conditions for consistency purposes.

In one embodiment, the aluminum alloy article has a composition comprising of the following in weight percent:

between about 0.05 and 0.5% silicon;

an amount of iron between about 0.1 and up to 1.0%;

up to about 0.7% copper, preferably, up to about 0.5%, more preferably up to about 0.35%, and most preferably, less than about 0.03%;

an amount of manganese up to about 2.0%;

less than or equal to about 1.0% magnesium; preferably less than about 0.5%, more preferably less than about 0.1%, and in some cases, essentially magnesium-free;

up to about 0.5% chromium;

between about 0.06 and 1.0% zinc;

less than about 0.01% nickel;

between about 0.03 and 0.35% titanium;

less than about 0.3% zirconium;

with the balance aluminum and inevitable impurities; the article containing intermetallic compounds having an aspect ratio of less than about 5.0, wherein the manganese to iron ratio is maintained between greater than about 0.5 and less than or equal to about 6.0, and the iron and manganese amounts total greater than about 0.30%, more preferably greater than about 0.32%, and include a preferred range of between about 0.6 and 3.0%. An even more preferred range of the total amount of manganese and iron ranges between about 0.8 and 1.0%.

The invention can also be described as an aluminum alloy containing intermetallic compounds (particles) dispersed throughout the alloy, the compounds having a volume fraction of at least 0.5%, preferably greater than 3.0%, having an aspect ratio of less than 5.0, having a size range of 0.5–5.0 microns in the short transverse direction, having a difference in electrolytic potential less than 0.2 volts, preferably 0.1 volts, between the intermetallic compounds and aluminum matrix. One way to arrive at this solution is to change the elemental alloying additions such that the above teaching is reiterated.

The amount of intermetallic particles is a function of the content of iron and manganese. If too little of iron and manganese are in the alloy, e.g., less than about total Mn+Fe of 0.3%, insufficient intermetallic particles will form and formability will be compromised. At the same time, the balance between iron and manganese should be such that the intermetallics are primarily $(Fe,Mn)Al_6$ or $MnAl_6$, or a combination thereof, to avoid the problems of corrosion discussed above. This balance is achieved by following the ratio and amount limits for iron and manganese of the invention.

More preferred ranges for the elements of zinc, silicon, magnesium, copper, titanium, chromium, nickel, and zirconium can be found in U.S. Pat. No. 5,976,278 to Sircar.

More preferred embodiments of the invention include specifying the lower range of the Mn/Fe ratio to be between about 0.75, or about 1.0, more preferably about 1.5, more preferably yet about 2.0, and even 2.5.

The upper range of the Mn/Fe ratio can range from the 6.0 noted above to a preferred upper limit of 5.0, a more preferred upper limit of 4.0, and an even more preferred limit of about 3.0.

While the upper and lower compositional limits of iron and manganese are shown in FIG. 5 in terms of amounts of manganese and iron, a preferred upper limit of iron includes about 0.7%, more preferably about 0.5%, even more preferred about 0.4%, 0.3%, and 0.2%.

Likewise, the manganese preferred upper limits range from the 2.0% mentioned above to more preferred values of about 1.5%, even more preferred 1.0%, and still more preferred values of about 0.75%, yet even 0.7%, 0.6%, or 0.5%.

A preferred lower limit of iron is 0.20%. A preferred lower limit of manganese is about 0.5%.

The amount or volume fraction of intermetallic particles should be such that the aluminum alloy has the formability to be expanded. In addition, the particle chemistry should be selected so that there is loss of corrosion resistance. As noted above, the prior art AA3102 alloy has particles in an amount of about 3.0% by volume that are predominantly $FeAl_3$, which adversely affects corrosion resistance.

This is believed to be confirmed by energy dispersive spectroscopy (EDS) plots made based on prior art alloys and alloys according to the invention. These plots identify the composition of the particles being analyzed by showing peaks that are associated with a particular element. The higher the peak, the more dominant that element is in the composition of the particle. FIG. 3 is a schematic representation of such a plot for the intermetallic particles shown in FIG. 1, i.e., an AA3102 alloy. This Figure shows that the particles of the AA3102 alloy are primarily $FeAl_3$. Although not depicted, EDS plots of the particles of the alloy of FIG. 2, i.e., the alloy described in U.S. Pat. Nos. 5,906,689, were also made. Similar to the chemistry of the particles found in AA3102 and depicted in FIG. 1, the particles shown in FIG. 2, from the alloy described in U.S. Pat. No. 5,906,689, are also primarily $FeAl_3$.

In comparison, EDS plots were made of the intermetallic particles of the inventive alloy, one such plot schematically shown in FIG. 4. This plots shows a peak of manganese that exceeds that shown in FIG. 3, thus indicating that the particles of the inventive alloy are primarily $(Fe,Mn)Al_6$. For the reasons explained below, the chemistry of the particles found in the inventive alloy contributes to the enhanced corrosion resistance. These particles are not of the same chemistry found in the AA3102 alloy or the alloy of U.S. Pat. No. 5,906,689.

In this regard, the corrosion resistance of aluminum is affected by the chemical potential of intermetallic particles in the aluminum matrix. Manganese in particular has an important effect on aluminum and its alloys in terms of corrosion resistance. Manganese compounds formed in aluminum have electrolytic potentials that differ only a few mV at most from the potential of aluminum. Table I shows the potentials of several aluminum alloys and compounds. Based on Table I, there is practically no difference whether the manganese is in solution in the aluminum or as compounds, thus aluminum-manganese alloys are not susceptible to intergranular or stress corrosion. This similarity of potential also means that pitting corrosion is limited: even when the compound is less electronegative than aluminum, the amount of aluminum that corrodes to protect the compound is minimal.

Moreover, a small amount of copper, of the order of 0.05–0.20% Cu, dissolved in the aluminum, is sufficient to bring the potential of the aluminum on the positive side of the compounds. Although the presence of copper tends to increase the rate of attack, when the potential of the matrix is positive to that of the compound, only the compound corrodes and the pit is small and shallower. Thus, in copper-bearing alloys, loss of weight is slightly increased, but depth of penetration is reduced. In some corrosive conditions this behavior makes the aluminum-manganese alloy more resistant to pitting corrosion than aluminum. Although the number of compound particles is much larger in aluminum-manganese alloys and thus many more pits develop, the fact that only the compound particles corrodes, but not the matrix around them, makes the pitting less serious than in aluminum, in which the matrix corrodes to protect the iron-bearing compounds.

Iron and iron-silicon compounds in aluminum alloys are strongly positive in respect the aluminum matrix, thus pitting of the matrix to protect the compounds may be severe. When iron and silicon are absorbed into the (Fe,Mn) $Al_6$ or the $(FeMn)_3$—$Si_2Al_{15}$ compounds, the difference of potential between compounds and matrix disappears and the pitting is greatly reduced, if not eliminated. Moreover, silicon has a tendency to precipitate from solid solution and create at the grain boundaries precipitate-free zones that introduce into the alloys a mild susceptibility to intergranular corrosion. This susceptibility is small and appears only in special corrosive conditions, but can be easily eliminated by adding manganese to the alloy to absorb the silicon into a manganese-silicon compound. These corrosion-reducing effects are maximum in alloys without larger amounts of copper, magnesium, zinc, although manganese improves corrosion resistance also on the complex alloys.

TABLE I

ELECTROLYTIC POTENTIAL OF SEVERAL ALUMINUM ALLOYS AND COMPOUNDS in NaCL-$H_2O_2$ solution, against a 0.1N Calomel electrode, in volts

| ALLOY | POTENTIAL (V) |
|---|---|
| A1 (high purity) | −0.85 |
| A1 + 1% Mn in sol. | −0.85 |
| $MnAl_6$ | −0.85 |
| $FeMnAl_{12}$ | −0.84 |
| $FeAl_3$ | −0.56 |
| $Fe_2SiAl_8$ | −0.58 |

As noted above, FIG. 4 signifies that the intermetallics of the inventive alloy are (Fe,Mn)$Al_6$ particles. Based on the discussion of electrolytic potential above, these (Fe,Mn)$Al_6$ particles more closely match the aluminum matrix from an electrolytic potential standpoint. Consequently, the corrosion phenomena associated with AA3102 under SWAAT conditions, i.e., the $FeAl_3$ particles differing greatly in electrolytic potential from the aluminum matrix, is lacking in the inventive composition. The inventive alloy therefore does not exhibit the corrosion problem of AA3102, but still has excellent formability.

In the inventive alloy, it is preferred to have a volume fraction of at least about 2.0% of the intermetallics, with a more preferred volume fraction of at least 3.0%. Micrographs of the inventive alloy confirm that the volume fraction distribution of the intermetallic particles is similar to that of the AA3102 alloy of FIG. 1. It is believed that this volume fraction of intermetallics contributes to the improved formability of the invention over alloys such as that disclosed in U.S. Pat. No. 5,906,689.

FIG. 5 shows the alloy composition in terms of the limits of manganese and iron in graphical form. The invention in its broadest embodiment is believed to encompass the region outlined by Box F, with more narrow and preferred limits as described above. Box F has the optimum combination of formability, hot workability, and corrosion resistance over other prior art alloys. For example, AA3102 generally has an Mn/Fe ratio that is less than 0.5%, falling in Box D. Such a ratio results in the formation of intermetallics that are primarily $FeAl_3$, these being conducive to galvanic corrosion effects. Other prior art alloys such as those disclosed in U.S. Pat. No. 5,906,689 have an insufficient volume fraction of intermetallics, thereby falling in Box B, and lacking good formability.

It is believed that ratios of Mn/Fe exceeding 6.0 result in an alloy composition containing intermetallic particles that have a needle or acicular morphology. FIG. 6 is a schematic of a micrograph of an alloy having excessive levels of manganese that are outside the scope of the invention. The composition of this alloy is best represented by U.S. Pat. No. 5,976,278 to Sircar. The depicted intermetallics 9 dispersed in the matrix 11 are both predominantly $MnAl_6$ and have an acicular or needle-like morphology. This morphology is undesirable for formability and is indicative that exceeding the upper limits of the range of manganese will produce a microstructure that is not as easily formed as one as depicted in FIG. 1. Thus, the Mn/Fe ratio should be maintained such that the intermetallics have a generally equiaxial morphology (be equiaxed), the aspect ratio should not be too high to form the needle-like intermetallics of FIG. 6. In this regard, the particle shape can be spheres, cubes or a blend thereof. As noted above, the aspect ratio should not exceed about 5.0, and is preferably closer to 2.0 and more preferably about 1.0.

A preferred compositional range for the inventive alloy is between about 0.04 and 0.10% Si, between about 0.15 and 0.35% Fe, less than 0.01% copper, between about 0.4 and 0.9% Mn, less than 0.01% Mg, less than 0.01% Cr, between 0.1 and 0.2% Zn, between 0.1 and 0.2% Ti, with the balance aluminum and inevitable impurities.

While the invention is described in terms of a composition, it is equally as significant that this composition when used as tubing in heat exchanger application is vastly improved over prior art tubing. Thus, the invention also entails the use of such a composition in tubing and sheet product that is used in applications requiring good formability, particularly, tubing in heat exchanger applications.

One of the important factors in achieving the optimum performance of the inventive alloy is the control of the manganese and iron levels such that the intermetallic particles are primarily (Fe,Mn)$Al_6$ rather than $FeAl_3$. The available manganese out of solution is important in driving the intermetallic particle formation away from the undesirable $FeAl_3$.

FIG. 7 plots the total amount of manganese and iron versus the percentage of manganese out of solution for the compositions shown in Table II, including AA3102, the alloy described in the Sircar '689 patent, and two other compositions according to the invention. As is evident from FIG. 7, as the total amount of manganese increases, the amount of manganese out of solution increases as well. Table II also shows that the inventive alloys are similar in volume fraction of intermetallic compounds to AA3102, thereby maintaining a good formability. At the same time, the levels of iron and manganese result in the presence of an intermetallic particle, e.g., $FeMnAl_{12}$. This compound is different from that of the prior art alloys AA3102 and PA-A, i.e., $FeAl_3$, thereby eliminating the adverse effects on corrosion resistance when these prior art particles are in an aluminum matrix.

TABLE II

| Alloy | Mn | Fe | Particle | vol. f. % | Mn IS % | Mn OS % | MnOS/Fe | Mn/Fe | MnOS + Fe | (MnOS/Fe)/MnOS + Fe |
|---|---|---|---|---|---|---|---|---|---|---|
| 3102 | 0.29 | 0.49 | $FeAl_3$ | 3.0 | 0.05 | 0.24 | 0.52 | 0.63 | 0.73 | 0.71 |
| PA-A | 0.23 | 0.07 | $FeAl_3$ | 0.1 | 0.18 | 0.05 | 0.78 | 2.88 | 0.12 | 6.5 |
| INV A | 0.70 | 0.25 | $FeMnAl_{12}$ | 3.0 | 0.40 | 0.30 | 1.27 | 2.8 | 0.55 | 2.3 |
| INV B | 0.50 | 0.25 | $FeMnAl_{12}$ | 2.0 | 0.29 | 0.20 | 0.83 | 2.0 | 0.45 | 1.8 |

MnIS: manganese % in solid solution
MnOS: manganese % out of solid solution
vol. f. %: volume fraction percent
alloy amounts in weight percent
PA-A is the alloy described in U.S. Pat. No. 5,906,689

Figure 8:
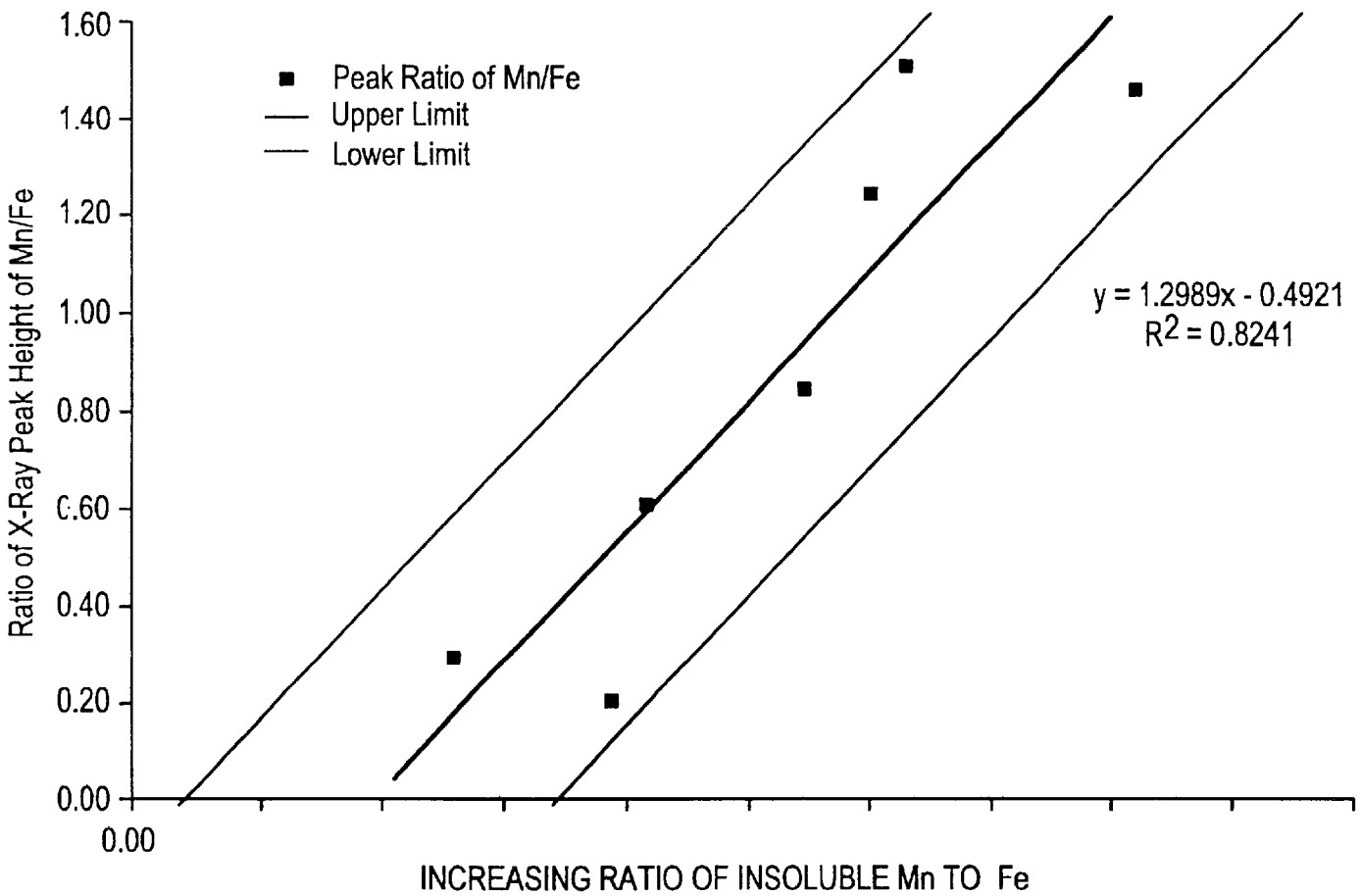
FIG. 8 is a graph comparing the ratio of insoluble manganese vs. iron against peak height ratio for EDS readings.

FIG. 8 plots that ratio of insoluble manganese vs. iron and the ratio of the x-ray peak height Mn/Fe, this height schematically shown in FIGS. 3 and 4. FIG. 8 shows that when the ratio of insoluble Mn/Fe increases, the peak height increases. In other words, increasing this ratio results in peak heights where the manganese exceeds the iron as shown in FIG. 4. This is the desirable situation since then the chemistry of the intermetallic particles, e.g., primarily (Fe,Mn) $Al_6$, is one that is more closely matched in electrolytic potential to the aluminum matrix, thereby reducing corrosion. When viewed together, the increase in manganese out of solution is believed to drive the formation of the intermetallics which then results in improved corrosion resistance.

In summary, Table II indicates that the alloys of the invention having good formability and corrosion resistance by having the desired intermetallics for corrosion resistance with the desired volume fraction and size of intermetallics as well. The prior art alloy AA3102 (good formability-poor corrosion resistance) has the volume fraction but not the right intermetallics, whereas the FIG. 2 alloy has good corrosion resistance (low volume fraction of undesirable intermetallics) but less than desirable formability (too low of a volume fraction of intermetallics). The inventive alloy solves this dilemma by combining the right intermetallics in the right chemistry, size and amount.

In addition, the invention does not compromise the hot workability of the aluminum alloy. It is known that the choice of alloying elements in aluminum can affect hot workability. Some elements may enhance this characteristic, whereas other elements are detrimental. By practicing the teachings of the invention through control of intermetallic particle chemistry and particle distribution, quite remarkably, the inventive aluminum alloy has not only good formability and corrosion resistance, but also hot workability that either matches of exceeds that of conventional alloys such as AA3102 or the alloy of U.S. Pat. No. 5,906,689. When conducting comparative trials between the prior art alloys and the invention for SWAAT corrosion resistance studies, the hot workability of the alloy of the invention was not compromised in spite of the deviations from the prior art in terms of particle chemistry and/or particle volume fraction.

Figure 9:
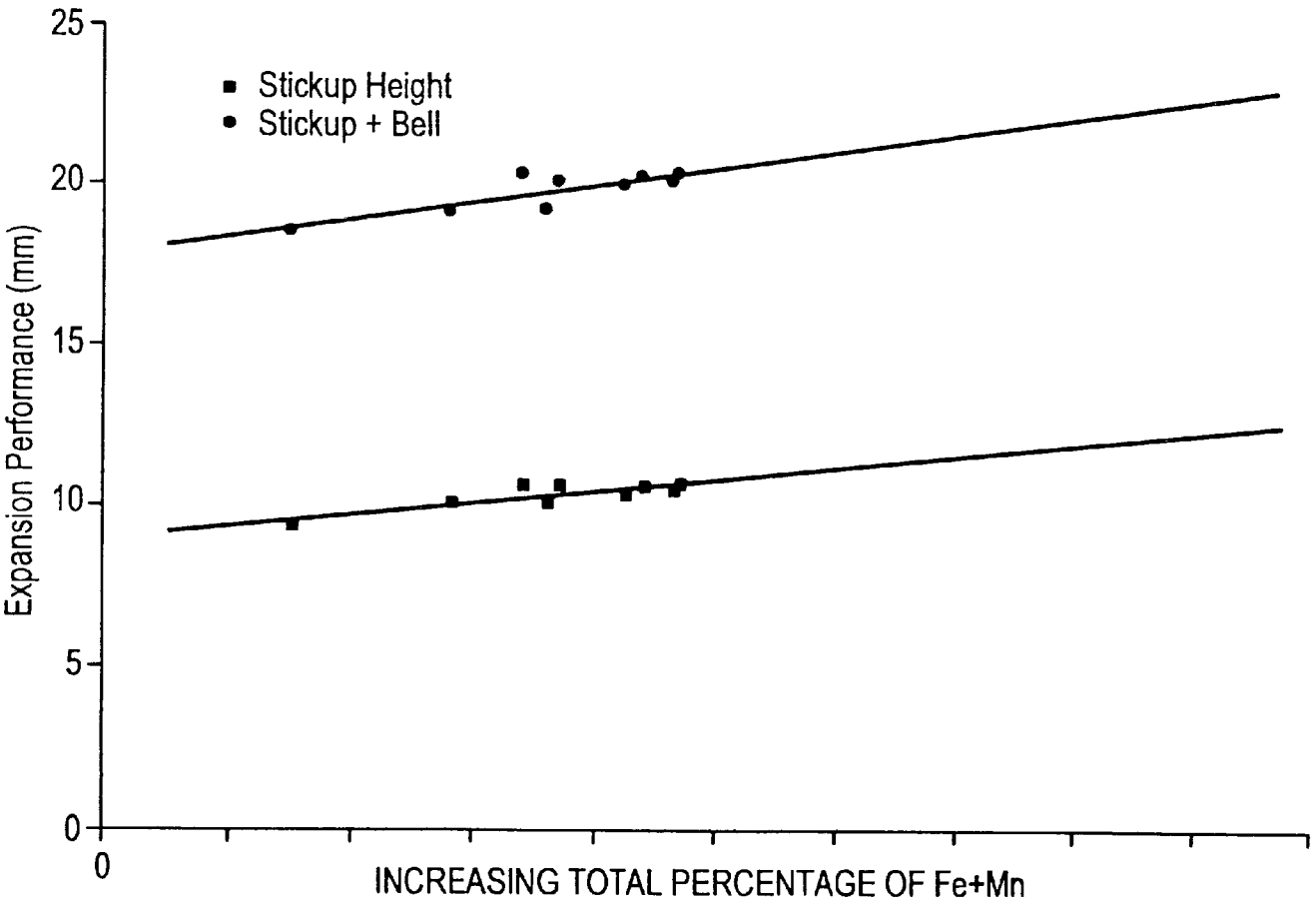
FIG. 9 is a graph showing the effect of the iron and manganese contents on the stickup height for various alloys.

FIG. 9 shows the improvement in stickup height when the inventive alloy is used in a heat exchanger application. As noted above, the stickup height is the height of the tube extending beyond the fin stock and end sheet after it has been inserted into the fin stock and diametrically expanded. This height must be long enough to allow for attachment of the tube free ends to the header manifold of the heat exchanger. FIG. 9 shows that a pronounced difference in stick-up height can be achieved when practicing the teachings of the invention. That is, when increasing the total amount of manganese and iron, an increase in both the stick-up height and stick-up+bell height is realized. Since the stick-up height is on the order of about 10 mm, a relatively small increase results in a significant percentage gain and vast improvement in manufacturing productivity. For example, increasing the stick-up height from about 9.5 mm to a stickup height of 10.5 mm accounts for a 10% gain. Increasing the available stickup height reduces the rejection rate of the condensers due to shrinkage of the tubing during the expansion step and insufficient tube height for heat exchanger header attachment.

It is also believed that the inventive alloy may have improved corrosion resistance. Scanning electron microscopy studies have been conducted to investigate the surface morphology of various alloys after 25 days of SWAAT testing. SWAAT testing is well known in the art, is explained in the Sircar patents mentioned above, and the details of such are not needed for understanding of this aspect of the invention. This study revealed that the PA-A alloy of Table II vastly exceeded the AA3102 alloy of the same table in terms of corrosion resistance. The surface of the AA3102 alloy was pitted and very non-uniform. In contrast, the PA-A alloy showed a general and uniform corrosion effect on the surface, such lending this material to superior performance in the field. From this comparison of micrographs, it is clear that the corrosion performance of the PA-A alloy is vastly superior to the AA3102 alloy.

The alloys of the invention were also studied under the same SWAAT test conditions and scanning electron micrographs were taken for comparison purposes. The surface etching of the alloys of the invention, INV A and INV B of Table II, revealed a surface morphology that appeared to be even more uniform than the highly-corrosion resistant PA-A alloy, i.e., less depth of penetration at the surface. From this, the inventive alloy has at least as good corrosion resistance as the prior art and may have even enhanced corrosion resistance compared to the enhanced corrosion resistant alloy of the prior art.

Besides being directed to an improved aluminum alloy, the invention also encompasses making heat exchangers, particularly process that employ an expansion step. In one mode, the invention is an improvement in methods whereby tubing is extruded, then shaped into a u-shape, then threaded into openings in fin stock and end sheet, and then diametrically expanded to assure contact between the tubing and the fin stock. In these methods, the inventive aluminum alloys are employed as the tubing stock for expansion and heat exchanger assembly. Of course, the composition may be formed into other shapes that require the optimum combination of corrosion resistance, hot workability, and formability if desired.

Any alloying addition that can be used interchangeably (via similar periodic group, etc.) and known in the art with those disclosed is also protected through this application.

The aluminum alloy may be made using known techniques such as ingot or continuous casting, homogenizing, hot and cold working, and extruding the worked product into tubing, rolling into sheet, and the like. Since the techniques are considered conventional, no further explanation is believed to be necessary for understanding of the invention.

For sheet application, in some instances, the higher levels of magnesium noted above may be preferred for strengthening purposes.

In yet another embodiment, the invention allows for improving corrosion resistance and formability by controlling the iron and manganese of an aluminum alloy when making it into an article. As noted above, by tailoring the alloy chemistry to the desired ratios and levels of iron and manganese, in combination with the other alloying elements, improvements are realized in formability without a loss in corrosion resistance or hot workability.

As such, an invention has been disclosed in terms of preferred embodiments thereof which fulfills each and every one of the objects of the present invention as set forth above and provides a new and improved aluminum alloy, a method of use in heat exchanger applications, and a method of manufacture.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An aluminum alloy article made of an alloy composition comprising, in weight percent:

between about 0.05 and 0.5% silicon;

an amount of iron between about 0.1% and up to 1.0%;

an amount of manganese up to about 2.0%;

between about 0.06 and 1.0% zinc;

between about 0.03 and 0.35% titanium;

with the balance aluminum and inevitable impurities;

wherein the manganese to iron ratio is maintained between greater than about 0.5 and less than or equal to about 6.0, and the iron and manganese amounts total greater than about 0.30% such that the article contains intermetallic compounds dispersed throughout an aluminum matrix in a volume fraction of the article of at least 0.5%, and wherein a difference in electrolytic potential between an aluminum matrix of the article and the intermetallic compounds is less than about 0.2 volts, the intermetallic compounds having an aspect ratio of less than about 5.0.

2. The article of claim 1, wherein the ratio of manganese to iron is further limited to a lower limit of 0.75 and an upper limit of about 5.0, and the manganese and iron total amount is at least about 0.6%.

3. The article of claim 2, wherein the manganese to iron ratio is between about 1.0 and 4.0, and the total amount of manganese and iron is between about 0.70 and 1.2%.

4. The article of claim 1, wherein the intermetallic compounds are primarily at least one of iron-aluminum-manganese compounds or manganese-aluminum compounds.

5. The article of claim 1, wherein iron is between about 0.15 and 0.35% Fe, and manganese is between about 0.4 and 0.9% for the ratio and the total amounts of manganese and iron ranges between about 0.6 and 3.0%.

6. The article of claim 1, wherein the volume fraction is greater than about 2.0%.

7. The article of claim 1, further comprising up to about 0.7% copper, less than about 1.0% magnesium; less than about 0.01% nickel, and up to about 0.5% chromium.

8. The article of claim 1, wherein the intermetallic compounds have a size range of between about 0.5 and 5 microns.

9. A heat exchanger having a component made from the alloy of claim 1.

10. The heat exchanger of claim 9, wherein the compoinent is tubing or sheet product.

* * * * *